US006176819B1

(12) United States Patent
Boegli et al.

(10) Patent No.: US 6,176,819 B1
(45) Date of Patent: Jan. 23, 2001

(54) DEVICE AND METHOD FOR EMBOSSING A FOIL

(75) Inventors: Charles Boegli, Marin; Bernard Wist, Bellmund, both of (CH)

(73) Assignee: Boegli-Gravures S.A., Marin-Epagnier (CH)

( * ) Notice: Under 35 U.S.C. 154(b), the term of this patent shall be extended for 0 days.

(21) Appl. No.: 09/210,814

(22) Filed: Dec. 15, 1998

(30) Foreign Application Priority Data

Dec. 19, 1997 (CH) ..... 2923/97

(51) Int. Cl.[7] ..... B31B 1/14

(52) U.S. Cl. ..... 493/355; 493/60; 493/194; 493/241; 493/287; 493/351; 493/364

(58) Field of Search ..... 493/194, 223, 493/227, 241, 287, 351, 364, 370, 58, 60

(56) References Cited

U.S. PATENT DOCUMENTS

| | | | |
|---|---|---|---|
| 1,571,594 | 2/1926 | Lorenz | 493/353 |
| 5,007,271 | 4/1991 | Boegli | 156/206 |
| 5,036,758 | 8/1991 | Kobayashi et al. | 493/467 |
| 5,203,761 * | 4/1993 | Reichental et al. | 493/346 |
| 5,379,019 * | 1/1995 | Fiddes et al. | 335/216 |
| 5,571,425 * | 11/1996 | Watzlaw | 216/33 |
| 5,598,774 | 2/1997 | Boegli | 100/171 |

FOREIGN PATENT DOCUMENTS

| | | |
|---|---|---|
| 2040042 | 3/1971 | (DE) . |
| 8713388 | 11/1987 | (DE) . |
| 139066 | 5/1985 | (EP) . |
| 2311949 | 10/1997 | (GB) . |

* cited by examiner

*Primary Examiner*—Peter Vo
*Assistant Examiner*—Hemant M. Desai
(74) *Attorney, Agent, or Firm*—Foley & Lardner

(57) ABSTRACT

The embossing process is effected between a pair of embossing rollers provided with toothings of the same kind which comprise rows of pyramidal teeth extending in the axial and the circumferential directions. Compared to the theoretical pyramid shape, the heads of the teeth are flattened while the edges of the pyramids are cut. The rollers, which are mutually displaceable in the axial direction, are thus able to catch in a stable mutual position of maximum penetration and to remain in this position in operation. This allows a safe mutual synchronization of the rollers and an optimal embossing of any kind of materials, especially of paper foils.

20 Claims, 5 Drawing Sheets

DEVICE AND METHOD FOR EMBOSSING A FOIL

BACKGROUND OF THE INVENTION

The present invention refers to a device for embossing a foil, the device comprising a pair of rollers which are provided with teeth of the same kind and which are coupled to a drive and capable of being driven in common, the rollers being capable of being pressed against each other in a resilient manner, and to a method for the operation of a device for embossing a foil which comprises a pair of rollers having toothings of the same kind which engage in each other in operation. A device of this kind is described in detail in U.S. Pat. No. 5,007,271. This known embossing device was based upon the problem of achieving both a high quality of the embossing and in particular a mutual synchronization of the embossing rollers in spite of the relatively fine teeth of the latter while only one of the rollers is driven and in turn drives the other roller. It had been found that these requirements were difficult to fulfill if the two rollers were equally provided with hardened teeth in order to ensure acceptable lifetimes of the rollers.

In order to fulfill the requirement of the mutual synchronization of the embossing rollers, the rollers were mutually aligned in such a manner that the circumferential rows of teeth of both rollers lie in the same plane, so that the flanks of the teeth in the meshing area of the two rollers contact one another and a forced driving of the idle roller by the driven roller results.

The mentioned disposition resp. the mutual alignment of the embossing rollers has been practical as long as the embossed foils, especially packing foils, were mainly aluminum foils. Recently, however, paper foils are increasingly used or even prescribed. These foils are substantially stiffer than aluminum foils, and it has been found that the known embossing rollers are no longer adapted to the requirements.

SUMMARY OF THE INVENTION

It is the object of the invention to provide a device which fulfills the new requirements, i.e. which allows an optimal embossing of any kind of foils. This object is attained by a device for embossing a foil wherein said device comprises a mode of operation in which the rollers are moveable relative to each other and mutually displaceable in positions of determined engagement of the roller teeth in order to allow a self-stabilizing operation. The dependent claims describe particular characteristics of an exemplary embodiment.

The invention further refers to an application of the device of the invention for the embossing of foils which are mainly composed of paper, and to a method for the manufacture of the embossing rollers wherein the teeth is exposed to an erosion subsequent to its shaping.

As mentioned, the determined mutual position of engagement of the roller teeth which is intended according to the invention not only ensures a stable mutual driving and a synchronization of the roller rotation but also an optimal embossing independently of the materials to be embossed. Therefore, the invention further refers to a method for the operation of a device for the purpose of embossing a foil wherein in continuous stationary operation, the rollers are operated in a mutual position in which each tooth in the contact area of each roller is enclosed at least approximately symmetrically between four teeth of the other roller.

BRIEF DESCRIPTION OF THE DRAWINGS

The invention will be explained in more detail hereinafter with reference to a preferred embodiment.

DETAILED DESCRIPTION OF THE INVENTION

For the fundamental structure of the embossing device, reference will be made to the above-mentioned U.S. Pat. No. 5,007,271. A foil band is passed between two toothed embossing rollers of which one is fixedly supported and driven while the other one is freely rotatably journalled on an axle and pressed against the driven roller with an adjustable pressure by spring force or by pneumatic or other means.

Figure 9B:
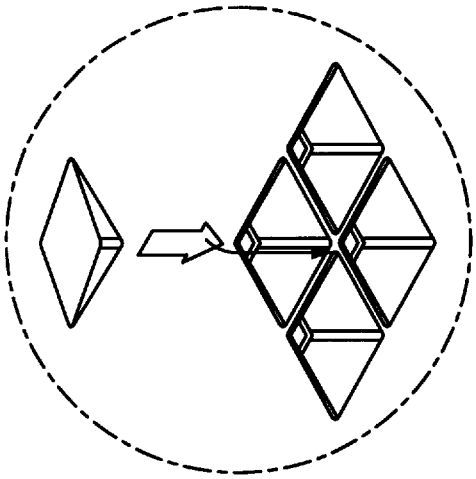
FIG. 9 shows a perspective view of two rollers, and an exploded view of the teeth of the rollers, in accordance with an embodiment of the invention.
Figure 9A:
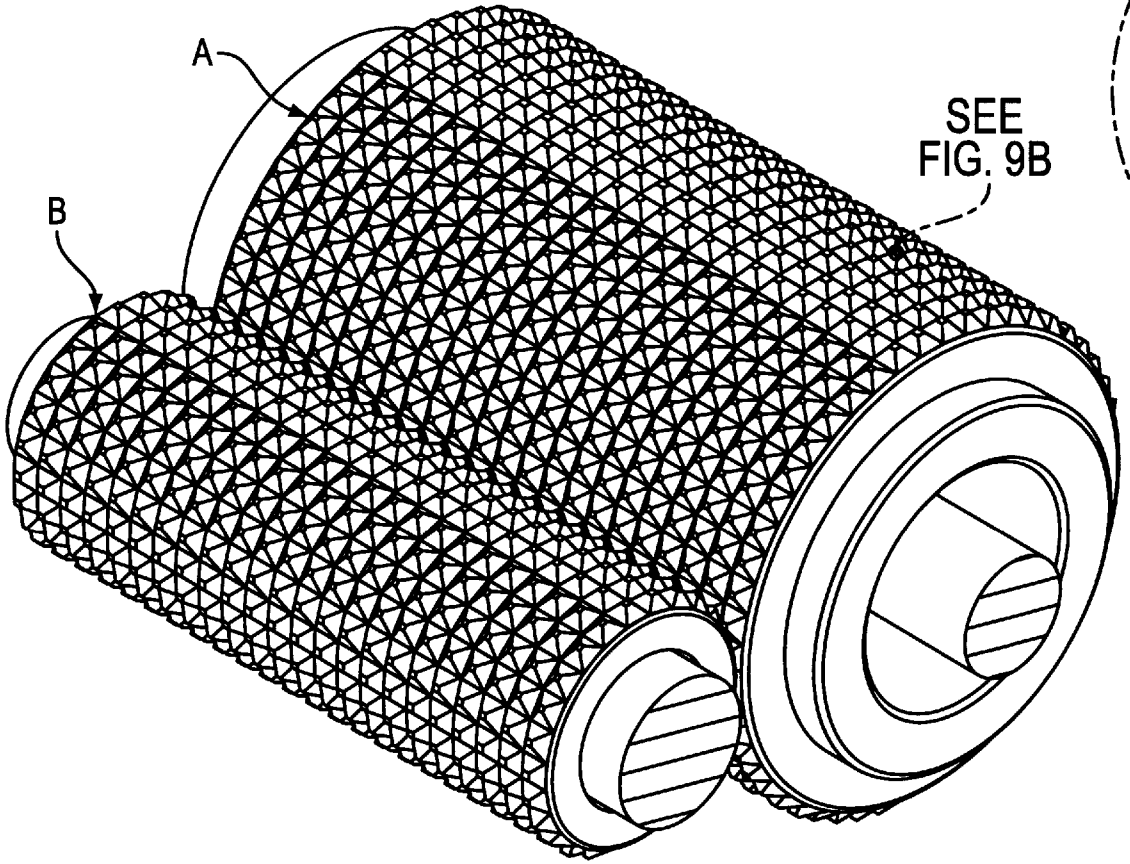
Figure 10B:
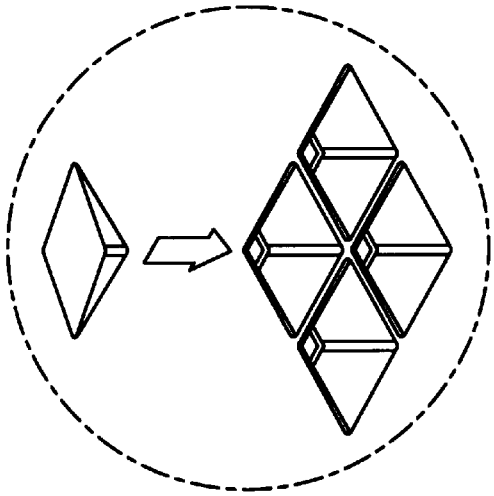
FIG. 10 shows a top view of two rollers, and an exploded view of the teeth of the rollers, in accordance with an embodiment of the invention.
Figure 10A:
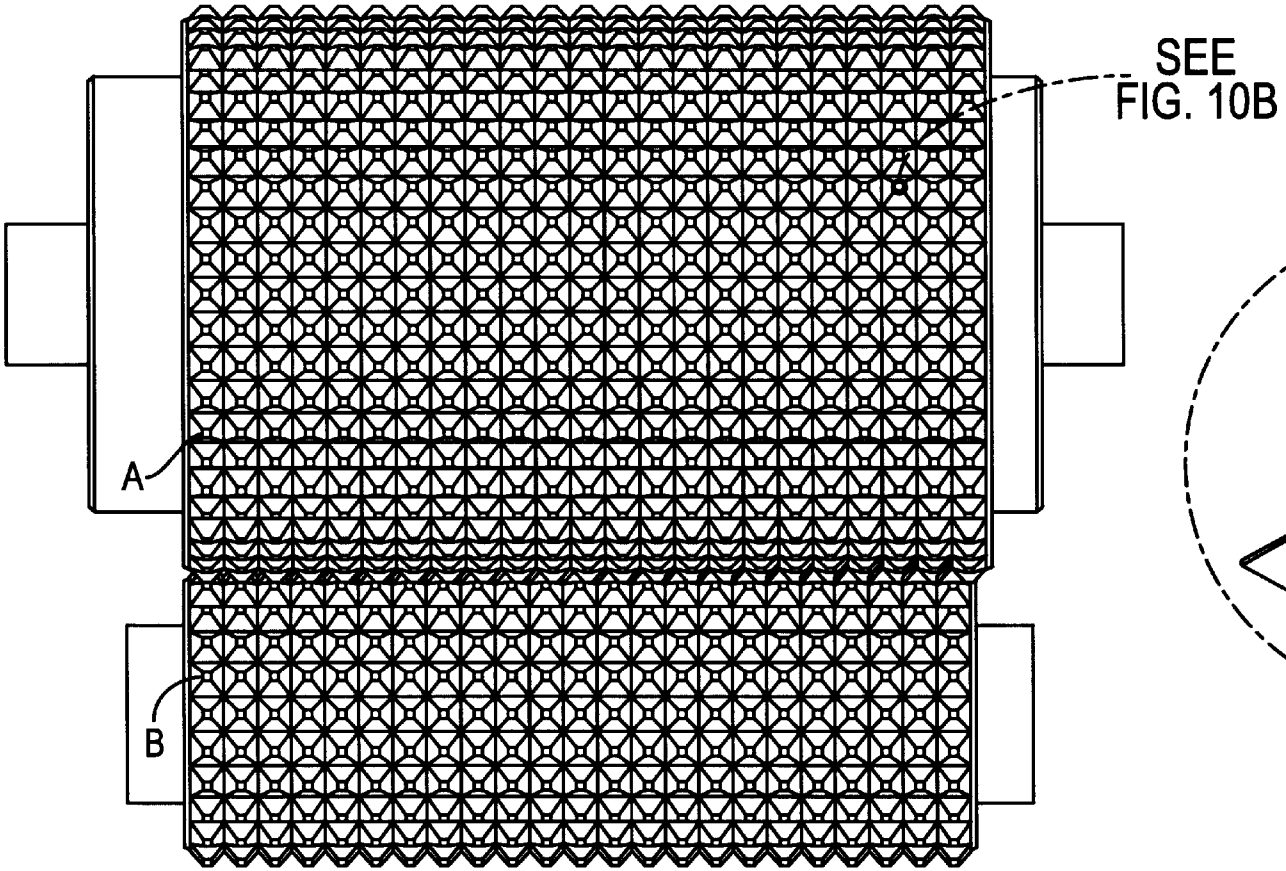
Figure 11B:
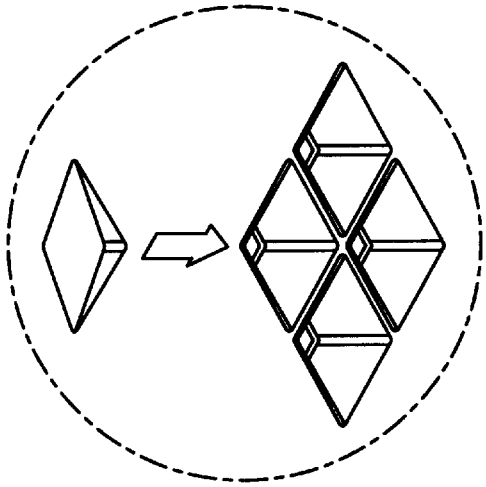
FIG. 11 shows a side view of two rollers, and an exploded view of the teeth of the rollers, in accordance with an embodiment of the invention.
Figure 11A:
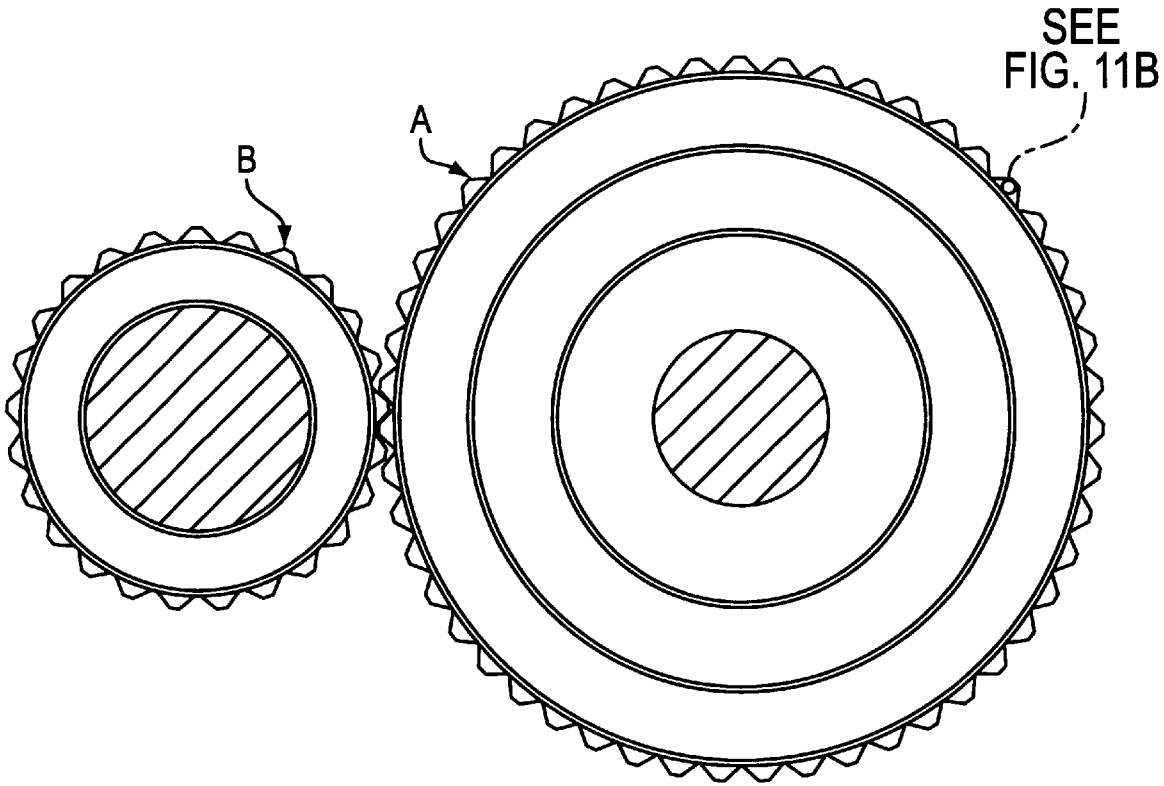

Exemplary embossing rollers in accordance with an embodiment of the invention A and B are illustrated in FIGS. 9–11.

Figure 1:
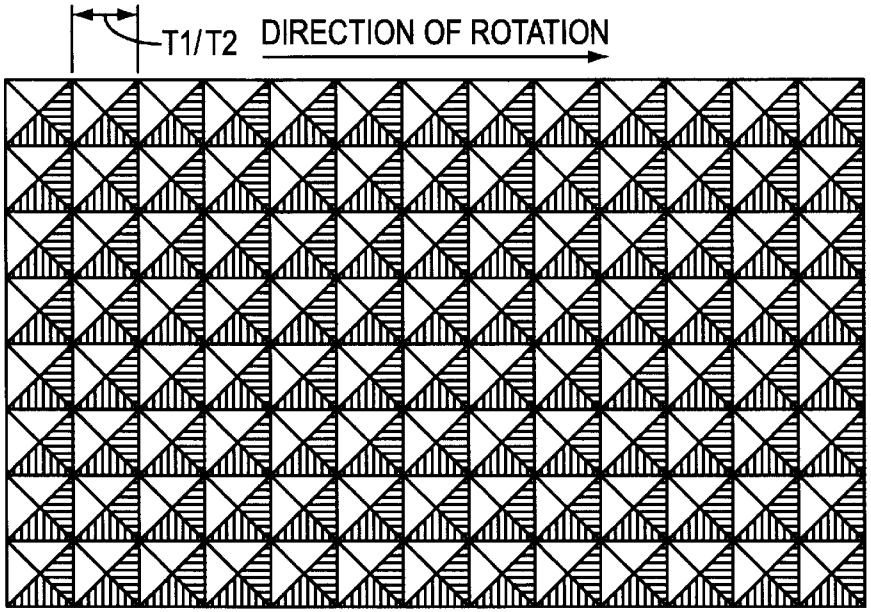
FIG. 1 shows a schematic representation of the toothing of an embossing roller in a developed view.

Both embossing rollers are provided with a superficial array of teeth of a kind which is schematically shown in FIG. 1 in a developed view, as shown, the teeth are pyramid shaped and are arranged in rows extending in the circumferential direction and perpendicularly thereto in the axial direction. As mentioned, FIG. 1 is a schematical representation, i.e. the pyramidal teeth of the present embodiment of the invention are illustrated as if they had the precise geometrical shape of a pyramid with an acute point, which was indeed the case in the mentioned embodiment of the prior art.

According to a novel feature, the points of the teeth are flattened as shown in FIGS. 2 to 5, and in FIGS. 9–11. As shown the teeth are shortened by an amount $\Delta A$ (FIG. 3) which in practice is equal to at least 2%, preferably 5 to 25% of the theoretical geometrical tooth height. Furthermore, the edges of the pyramidal teeth resp. of the truncated pyramids are cut. This may be achieved, for example, by a generally erosive finishing treatment subsequent to the machining of the toothing, e.g. by an etching or a galvanic erosion which mainly affects the edges.

Another difference with respect to the known embodiment, where the mutual axial position of the embossing rollers was predetermined, is that the rollers are mutually displaceable with a relative axial play of at least half a tooth pitch, preferably of three quarters of a tooth pitch, in order to allow a mutual displacement to a stable position, as will be explained below.

Figure 2:
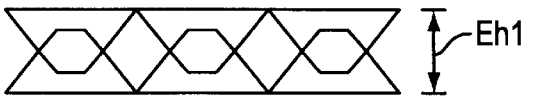
FIGS. 2 and 3 show a position of engagement of the toothings of the embossing rollers when the device is started.
Figure 3:
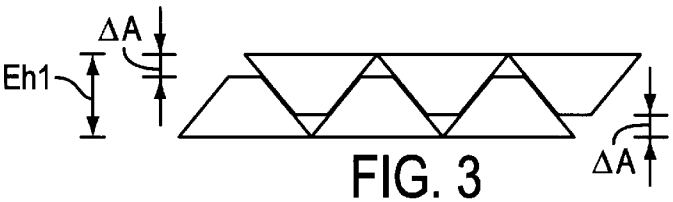
Figure 4:
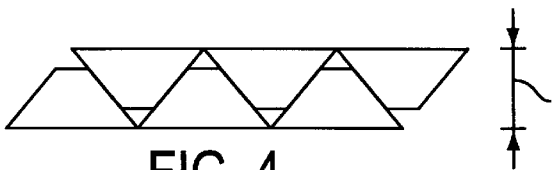
FIGS. 4 and 5 show the stable position of engagement of the toothings of the embossing rollers.

When the embossing rollers are first joined and pressed against each other with an inserted foil band and set in motion as the device is started, it is highly probable that in the contact area of the rollers, the relative tooth position according to FIGS. 2 and 3 results. FIG. 2 shows the relative tooth position in the circumferential direction, and FIG. 3 shows the relative tooth position in the axial direction. According to FIG. 3, the flanks of the teeth contact each other, thus resulting in a mutual working height $E_{H1}$.

Figure 5:
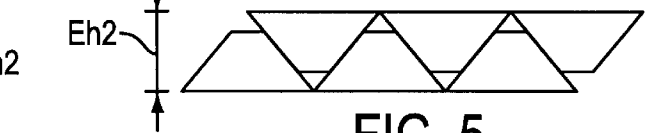
Figure 6:
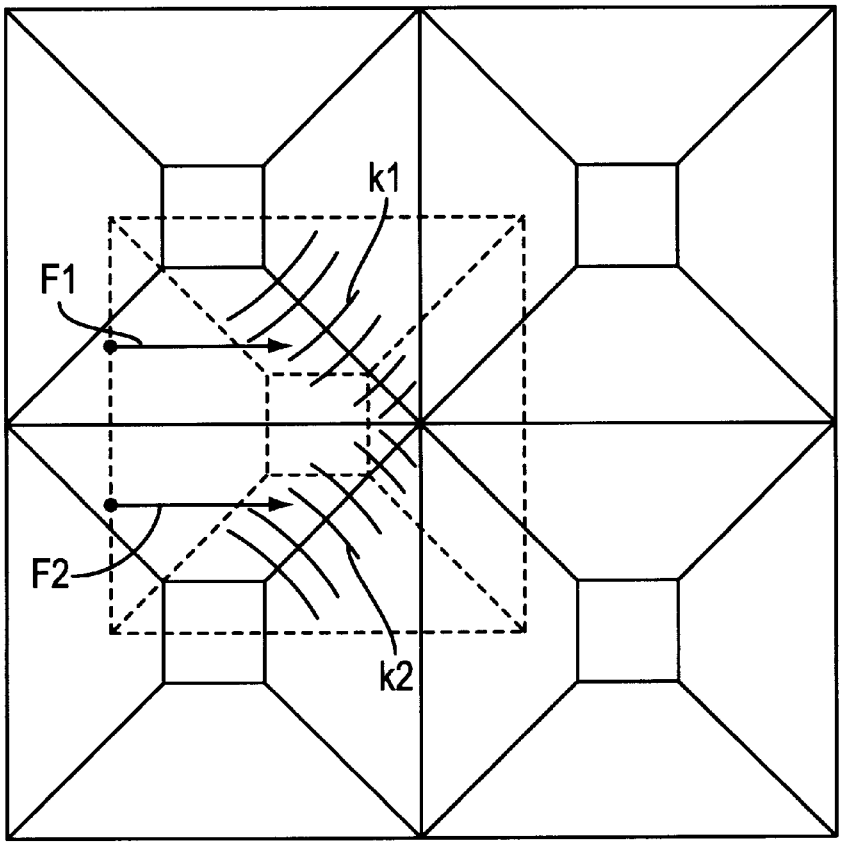
FIG. 6 illustrates the influence of a led through foil on the self-stabilization of the mutual roller positions.

Since the embossing rollers are in rotation, they tend to a mutual axial displacement, and if the teeth of the two rollers cease to run on the respective tooth flanks, the rollers resp. their toothings will interpenetrate deeper, thus resulting in a smaller working height $E_{H2}$. This relative position of the teeth is illustrated in FIGS. 4 and 5, where FIG. 4 again shows the relative tooth position in the circumferential direction and FIG. 5 shows the relative tooth position in the axial direction. It appears that the teeth are now mutually engaged in such a manner that each tooth is symmetrically enclosed between four teeth of the other roller, i.e. that the teeth contact each other along their edges, and since the edges of the teeth are cut and their points are flattened, the toothings will settle or catch in a deeper position of engagement which is stable and from which they do not depart, as experience shows. The toothings thus stabilize themselves dynamically in a certain position. As shown in FIG. 6, this self-stabilizing effect is reinforced by the foil passed between the embossing rollers.

In any position of engagement of the two embossing rollers, the embossed material is forced around structural edges K1, K2. This produces a paper tension which generates the forces F1 and F2 on the idle roller, thereby contributing to a displacement of this embossing roller from the instable position according to FIG. 6 to the stable position of maximum penetration according to FIGS. 4 and 5. As mentioned, a considerable force is required in order to displace the rollers out of the mutually stabilized position of maximum penetration in the axial or in the circumferential direction. A safe and stable driving of the idle roller with a constant mutual tooth position in the corresponding range of engagement is therefore ensured. At the same time, an optimal embossing, especially also of paper foils, is ensured. In the initial position of engagement, the teeth could also mutually contact the flanks in the axial direction, in which case the stable position of engagement would be attained by a relative displacement in the circumferential direction.

Figure 7:
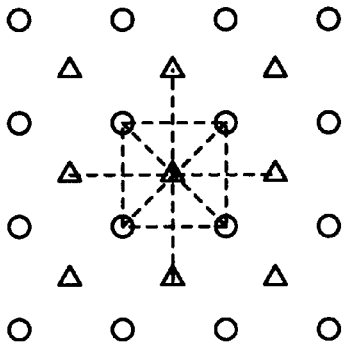
FIG. 7 schematically shows the stabilized mutual position of the roller toothings according to the invention.
Figure 8:
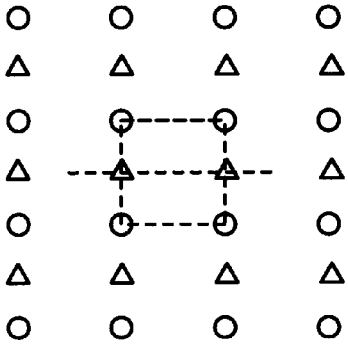
FIG. 8 shows a corresponding illustration in a stable mutual position of the rollers.

FIGS. 7 and 8 schematically show a comparison of the embossing process in the position of the invention (FIG. 7) and in the conventional tooth position (FIG. 8). In both figures, the points of the teeth of one roller are indicated by triangles and those of the other roller by circles. The dotted lines are the relevant breaking lines, and it appears that the embossing length in the tooth position of the invention is substantially longer than in the conventional tooth position while the foil nerves are not only folded free of tension but also in symmetrical diagonal directions additionally.

For a reliable operation, however, certain minimal conditions must be fulfilled as well. Thus, in the embossing procedure of the invention according to FIG. 7, the metallized paper can provide a dynamic compensation of a certain pitch error ΔT of the two embossing rollers due to its elasticity. In other words, an embossing according to the invention is no longer possible if the pitch difference ΔT is greater than a certain self-centering factor. In any case, the embossing pattern will deteriorate if the self-centering resp. -synchronization is not ensured. The terms of the following relationships are $T1$ = radial pitch of the first roller $T2$ = radial pitch of the second roller $\Delta T$ = pitch difference $T_{HT}$ = theoretical radial pitch (nominal pitch)

$S_{ZF}$ = self-centering factor $E_F$ = empirically determined factor = 98.75.

$$S_{ZF} = \frac{T_{HT}}{E_F} \quad \Delta T = T1 - T2 \quad S_{ZF} \geq |\Delta T|$$

In a numerical example, this means:

$$T1 = 0.402$$
$$T2 = 0.399$$
$$T_{HT} = 0.400$$
$$\Delta T = 0.402 - 0.399 = 0.003$$
$$S_{ZF} = \frac{0.400}{98.75} = 0.00405$$

$$0.00405 \geq 0.003,$$

which means that the self-centering effect is ensured. The preceding dimensions are all in mm.

The described preferred embodiment offers simplicity, reliability, long lifetimes of the rollers, a high quality of the embossing independently of the foil material, and simple operation. In this embodiment, it is advantageous to use the described tooth shape which allows the dynamic displacement into the preferred stable mutual position of the sets of teeth. Alternative embodiments are also possible, however.

The rollers may be provided with teeth of different heights or of the same height, i.e. the pitches have to correspond, of course, but the amount of flattening may vary. Preferably, in the case of different heights of the teeth, the idle, i.e. the undriven roller is provided with the lower teeth. It will be exposed to a slightly greater wear, but it is easier to exchange than the driven roller.

The rollers may also comprise means for a preliminary or coarse orientation, e.g. coarse sets of teeth at the edges resp. on the sides of the rollers which engage in each other at the start and provide a coarse orientation of the rollers, thus contributing to a correct engagement and the subsequent transfer of the rollers to their stable positions. These orienting means have to have enough play in order to allow a free mutual displacement of the rollers to the stable position.

It is also possible to lock the mutual roller positions as soon as the stable position of engagement is attained and thus to exclude any risk that the rollers might jump from a stable position to a different one. For example, as soon as the stable position is attained, the axial position of the idle roller might be locked by clamping the axially displaceable roller axle, and a previously uncoupled play-free gear could be connected between the two rollers. Ultimately, the rollers could also be mutually positioned by play-free gears or in such a disposition that a mutual engagement in the sense of the invention is predetermined from the start.

What is claimed is:

1. A device for embossing a foil comprising:

a pair of rollers each having a surface provided with a set of teeth;

each of the pair of rollers being moveable relative to the other so as to press against each other, whereby the set of teeth of each roller are configured to mutually engage each other via a film to be embossed that is disposed between the rollers;

one of said rollers being fixedly supported and driven, the other of said rollers being freely rotatable and capable of being driven by engagement with the fixedly supported roller;

wherein the freely rotatable roller is moveable both radially and circumferentially relative to the fixedly supported roller so that upon engagement of the rollers, the rollers self-adjust to a stable mutual position in which teeth of one of the rollers are each symmetrically enclosed between four teeth of the other roller.

2. The device of claim 1, wherein the sets of teeth on the rollers are configured to interpenetrate at a maximum depth to achieve the stable mutual position between each of the rollers.

3. The device of claim 1, wherein the teeth are shaped as pyramids with a flattened point.

4. The device of claim 3, wherein the edges of the teeth are cut.

5. The device of claim 1, wherein the teeth of one roller have a height different from the height of the teeth of the other roller.

6. The device of claim 1, wherein the height of the teeth of the freely rotatable roller is lower than the height of the teeth of the fixedly supported roller.

7. The device of claim 1, wherein the rollers each further include a second set of coarser teeth, the second set of teeth of one roller being configured to engage the second set of teeth of the other roller.

8. The device of claim 4, wherein the second set of teeth provide sufficient play between the rollers to allow mutual displacement of the rollers to the stable position.

9. The device of claim 1, further comprising a gear connected between the rollers, which gear engages the rollers when the rollers are in the stable position so as to reduce play between the rollers.

10. A method of embossing films, comprising: providing a device for embossing a foil comprised of: a pair of rollers each having a surface provided with a set of teeth; each of the pair of rollers being movable relative to the other so as to press against each other, whereby the set of teeth of each roller are configured to mutually engage each other via a film to be embossed that is disposed between the rollers; one of said rollers being fixedly supported and driven, the other of said rollers being freely rotatable and capable of being driven by engagement with the fixedly supported roller; wherein the freely rotatable roller is movable both radially and circumferentially relative to the fixedly supported roller so that upon engagement of the rollers, the rollers self-adjust to a stable mutual position in which teeth of one of the rollers are each symmetrically enclosed between four teeth of the other roller;

disposing a film substantially comprised of paper between the pair of rollers;

pressing the rollers against each o ther with the film therebetween; and driving the fixedly supported roller.

11. A device for embossing a foil comprising:

a pair of rollers each having a surface provided with a set of teeth, which teeth are shaped as pyramids with a point that is flattened by at least 2%;

each of the pair of rollers being moveable relative to the other so as to press against each other, whereby the set of teeth of each roller are configured to mutually engage each other via a film to be embossed that is disposed between the rollers;

one of said rollers being fixedly supported and driven, the other of said rollers being freely rotatable and capable of being driven by engagement with the fixedly supported roller;

wherein the freely rotatable roller is moveable both radially and circumferentially relative to the fixedly supported roller so that upon engagement of the rollers, the rollers self-adjust to a stable mutual position in which teeth of one of the rollers are each symmetrically enclosed between four teeth of the other roller.

12. The device of claim 11, wherein the teeth are flattened by between 5% and 25%.

13. The device of claim 11, wherein the sets of teeth on the rollers are configured to interpenetrate at a maximum depth to achieve the stable mutual position between each of the rollers.

14. The device of claim 11, wherein the edges of the teeth are cut.

15. The device of claim 11, wherein the teeth of one roller have a height different from the height of the teeth of the other roller.

16. The device of claim 11, wherein the height of the teeth of the freely rotatable roller is lower than the height of the teeth of the fixedly supported roller.

17. The device of claim 11, wherein the rollers each further include a second set of coarser teeth, the second set of teeth of one roller being configured to engage the second set of teeth of the other roller.

18. The device of claim 17, wherein the second set of teeth provide sufficient play between the rollers to allow mutual displacement of the rollers to the stable position.

19. The device of claim 18 further comprising a gear connected between the rollers, which gear engages when the rollers are in the stable position so as to reduce play between the rollers.

20. A method of embossing films, comprising:

providing a device for embossing a foil comprised of: a pair of rollers each having a surface provided with a set of teeth, which teeth are shaped as pyramids with a point that is flattened by at least 2%; each of the pair of rollers being movable relative to the other so as to press against each other, whereby the set of teeth of each roller are configured to mutually engage each other via a film to be embossed that is disposed between the rollers; one of said rollers being fixedly supported and driven, the other of said rollers being freely rotatable and capable of being driven by engagement with the fixedly supported roller; wherein the freely rotatable roller is movable both radially and circumferentially relative to the fixedly supported roller so that upon engagement of the rollers, the rollers self-adjust to a stable mutual position in which teeth of one of the rollers are each symmetrically enclosed between four teeth of the other roller;

disposing a film substantially comprised of paper between the pair of rollers;

pressing the rollers against each other with the film there between; and driving the fixedly supported roller.

* * * * *